US008616148B2

(12) United States Patent
Fujioka et al.

(10) Patent No.: US 8,616,148 B2
(45) Date of Patent: Dec. 31, 2013

(54) GAS WIPING APPARATUS

(75) Inventors: Hironori Fujioka, Hiroshima (JP); Takashi Yonekura, Hiroshima (JP); Masashi Yoshikawa, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 750 days.

(21) Appl. No.: 12/775,537

(22) Filed: May 7, 2010

(65) Prior Publication Data

US 2010/0282161 A1 Nov. 11, 2010

(30) Foreign Application Priority Data

May 8, 2009 (JP) ..... 2009-113132

(51) Int. Cl.
*B05C 11/06* (2006.01)

(52) U.S. Cl.
USPC ..... 118/62; 118/63; 15/309.1

(58) Field of Classification Search
USPC ..... 118/62, 63; 427/349, 434.2, 435; 15/309.1
See application file for complete search history.

(56) References Cited

U.S. PATENT DOCUMENTS

| | | | | |
|---|---|---|---|---|
| 5,119,848 | A * | 6/1992 | Muguruma et al. | 134/64 R |
| 5,786,036 | A * | 7/1998 | Pannenbecker et al. | 427/444 |
| 6,585,824 | B2 * | 7/2003 | Katagiri et al. | 118/698 |

FOREIGN PATENT DOCUMENTS

| | | |
|---|---|---|
| JP | S48-21634 | 3/1973 |
| JP | 55-148753 A | 11/1980 |
| JP | 2001-131724 A | 5/2001 |
| JP | 2003-221659 A | 8/2003 |

OTHER PUBLICATIONS

Japanese Office Action issued in Japanese Patent Application No. 2009-113132 on May 21, 2013.
German Office Action issued in German Patent Application No. 10 2010 015 662.0 on Nov. 13, 2012.

* cited by examiner

*Primary Examiner* — Laura Edwards
(74) *Attorney, Agent, or Firm* — Birch, Stewart, Kolasch & Birch, LLP

(57) ABSTRACT

In a gas wiping apparatus for blowing a gas on the front side and the back side of a strip, which exits from a hot-dip plating bath and travels upward, from wiping nozzles to adjust the amount of a plating deposit, the wiping nozzles are supported to be linearly movable beyond the width of the nozzles in the plate width direction of the strip.

1 Claim, 11 Drawing Sheets

GAS WIPING APPARATUS

BACKGROUND OF THE INVENTION

1. Field of the Invention

This invention relates to a wiping nozzle for use in a wiping apparatus on a hot dip galvanizing line for coating zinc or the like.

2. Description of the Related Art

In such a type of wiping apparatus, a surplus of molten zinc adhering to the surface of a strip (steel sheet or plate) exiting from a molten metal coating pot and traveling upward is removed by being wiped with a gas blown from a pair of wiping nozzles (gas wiping apparatus) opposingly installed above the molten metal coating pot, for example.

With such a gas wiping apparatus, a quality defect (coating irregularities, streaks, etc.) occurs on the surface of the strip after coating, if there is a scar on the wiping nozzle due to contact with the strip, or the deposition of the molten metal on the wiping nozzle (i.e., stain) attributed to a splash. This requires maintenance work including the replacement of the wiping nozzle. Alternatively, plural types of nozzles may be replaced in accordance with the quality of coating.

In such a case, the following operation as shown in FIG. 9 has been common practice with the conventional gas wiping apparatus: A strip S is cut above a molten metal coating pot 102, and a lower piece of the strip S cut is sunk in the molten metal coating pot 102, with the leading end of the strip being secured by a chain or the like. In this state, wiping nozzles 100*a*, 100*b* are lifted above the molten metal coating pot 102 by a moving crane or wires 101*a*, 101*b*, and moved out of a coating device such as the molten metal coating pot 102 so that maintenance, including replacement, of the wiping nozzles 100*a*, 100*b* is performed.

When a wiping nozzle 100*a*1 in operation is to be replaced by a wiping nozzle 100*a*2 placed in a wait state in the case of a turret nozzle, as shown in FIGS. 10A to 10C, the following motions have been made: (1) the nozzles retracted (see FIG. 10A→FIG. 10B)⇒(2) the nozzles lifted (see FIG. 10B→FIG. 10C)⇒(3) the nozzles rotated (see FIG. 10C)⇒(4) the nozzles lowered (see FIG. 10C→FIG. 10B)⇒(4) the nozzles advanced (see FIG. 10B→FIG. 10A).

In a case as in Patent Document 1, moreover, a pair of wiping nozzles are integrated with other wiping equipment via the base of a frame to form a wiping equipment assembly. In performing its maintenance including replacement, a strip is cut above a molten metal coating pot, and a lower piece of the strip cut is sunk in the molten metal coating pot by means of a chain or the like, as in FIG. 9. In this state, the wiping equipment assembly including the wiping nozzles is lifted by a moving crane or the like, and carried out of plating equipment (out of the line).

CITATION LIST

Patent Literature

Patent Document 1 JP-A-2003-221659

SUMMARY OF INVENTION

Technical Problem

With the apparatus as shown in FIG. 9, however, the line is stopped (whereby tension is released, and minimum combustion or inching is performed so that the strip is not broken by heat within the furnace), and a manual operation, such as the cutting of the strip S or the handling of the moving crane or the wires 101*a*, 101*b*, is needed above the molten metal pot 102. Thus, there have been the problems that the operating time is enormous, the operation is dangerous, and a downtime increase results in a low production efficiency.

With the apparatus as shown in FIGS. 10A to 10C, nozzle replacement can be performed during operation of the line. However, the motions for replacement are combined motions, making the structure complicated. Furthermore, the wiping nozzle 100*a*1 and the wiping nozzle 100*a*2 are rotated about a header 103, so that a space where the nozzles are rotatable needs to be ensured near the nozzles (see hatched areas in FIG. 10C). This has posed the problem that limitations are imposed on an apparatus design in disposing a damping device or the like.

With the system as shown in Patent Document 1, the entire wiping equipment assembly has to be lifted by the moving crane or the like, and carried out of the coating pot. Thus, the line has to be stopped, and the strip S has to be cut. As with the apparatus shown in FIG. 9, the problems have arisen that the operating time is enormous, and a downtime increase results in a low production efficiency.

Under these circumstances, it is an object of the present invention to provide a gas wiping apparatus which increases productivity and enhances, the ease of maintenance by the capability of shifting upper and lower nozzle toward strip width direction even while the strip is traveling, without stopping the line or cutting the strip.

Solution to Problem

To solve the above-mentioned problems, the present invention provides a gas wiping apparatus for blowing a gas on a front side and a back side of a steel strip, which exits from a molten metal coating pot and travels upward, from wiping nozzles to adjust an amount of a coating thickness, wherein the wiping nozzles are supported to be linearly movable beyond a width of the nozzles in a plate width direction of the steel strip.

Further, in the gas wiping apparatus, the wiping nozzles can be moved on guides, which are extended beyond the width of the nozzles, by drive means via movable frames.

Advantageous Effects of Invention

According to the gas wiping apparatus concerned with the present invention having the above-mentioned features, the wiping nozzles are linearly moved beyond the width of the nozzles in the strip width direction of the steel strip. By so doing, maintenance of the wiping nozzles, including their replacement, can be performed, with the coated steel strip being allowed to travel at a low speed without being cut. Thus, a gas wiping apparatus achieving a decrease in downtime and free from limitations on the designing of the apparatus can be realized.

DETAILED DESCRIPTION OF THE INVENTION

A gas wiping apparatus according to the present invention will be described in detail by embodiments with reference to the accompanying drawings.

Embodiment 1

Figure 1:
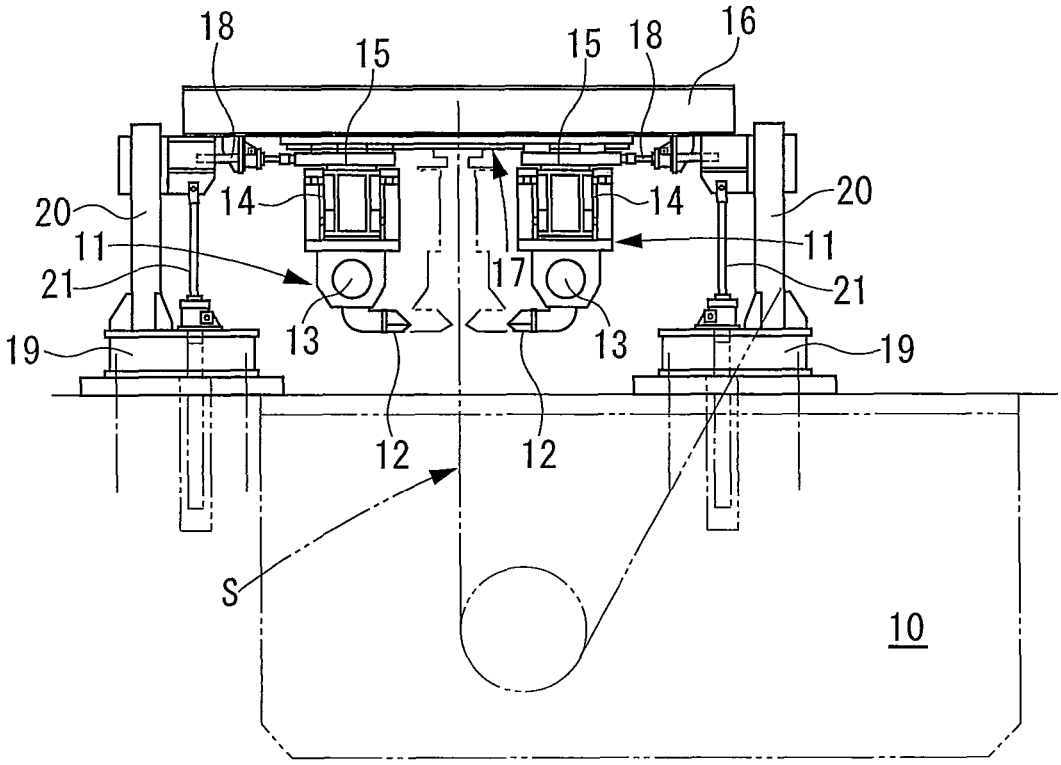
FIG. 1 is a schematic configurational side sectional view of a wiping apparatus on a continuous hot dip galvanizing line showing Embodiment 1 of the present invention.
Figure 2:
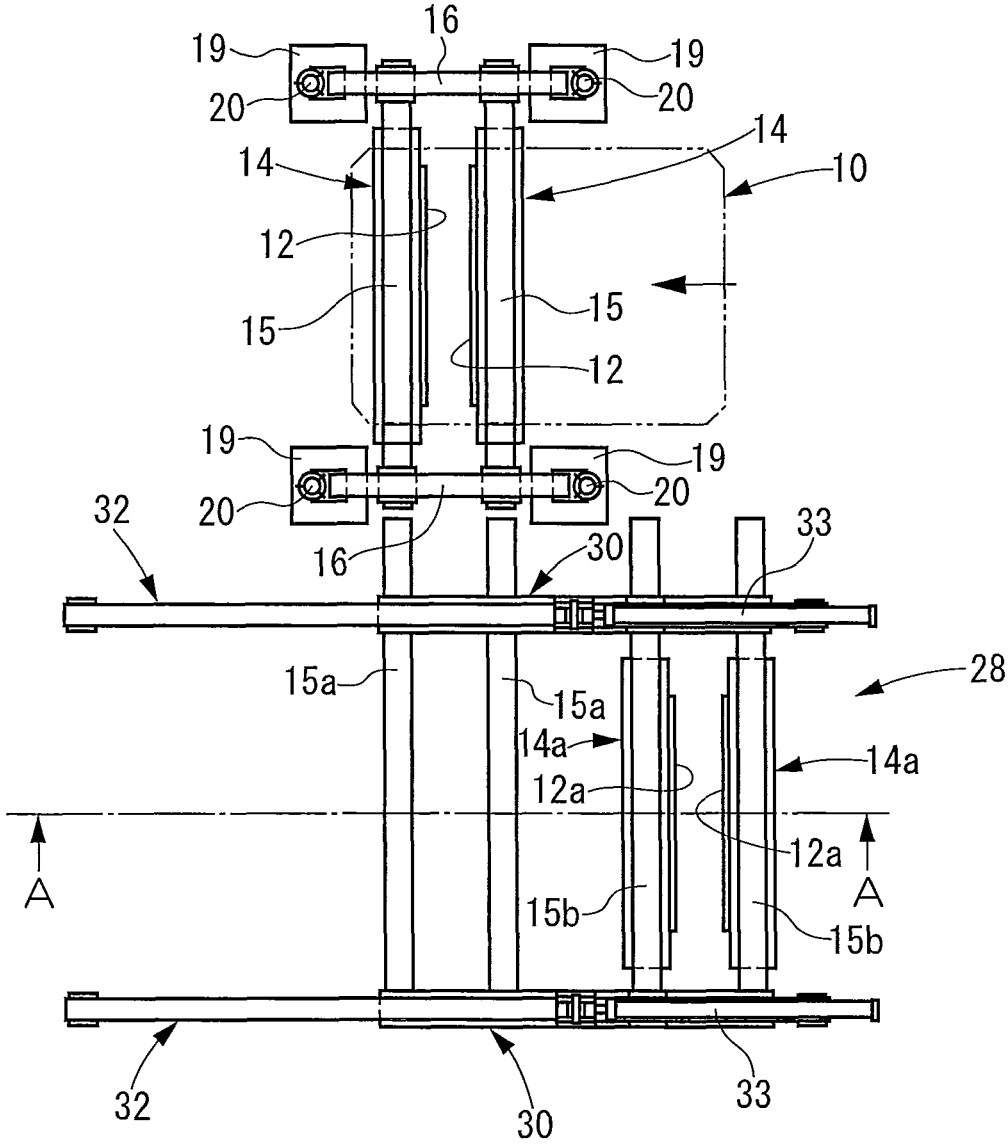
FIG. 2 is a plan view of gas wiping devices and a nozzle replacing device.
Figure 3A:
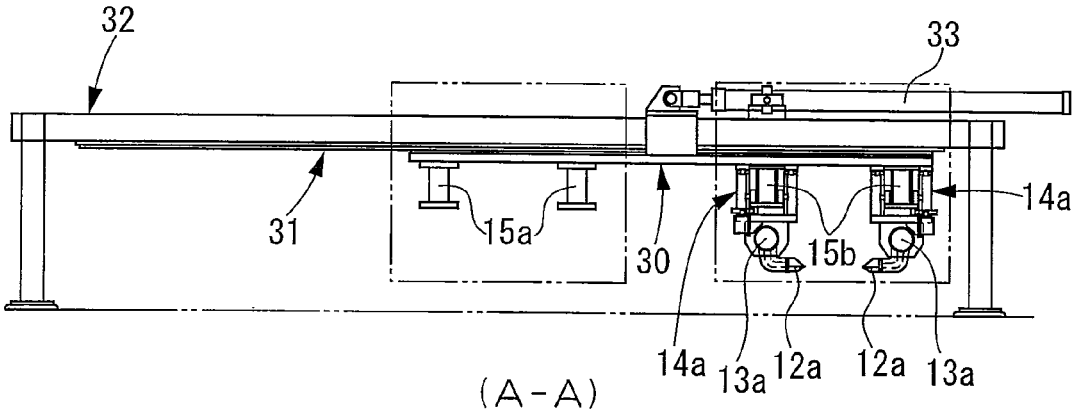
FIG. 3A is a sectional view taken along line A-A in FIG. 2.
Figure 3B:
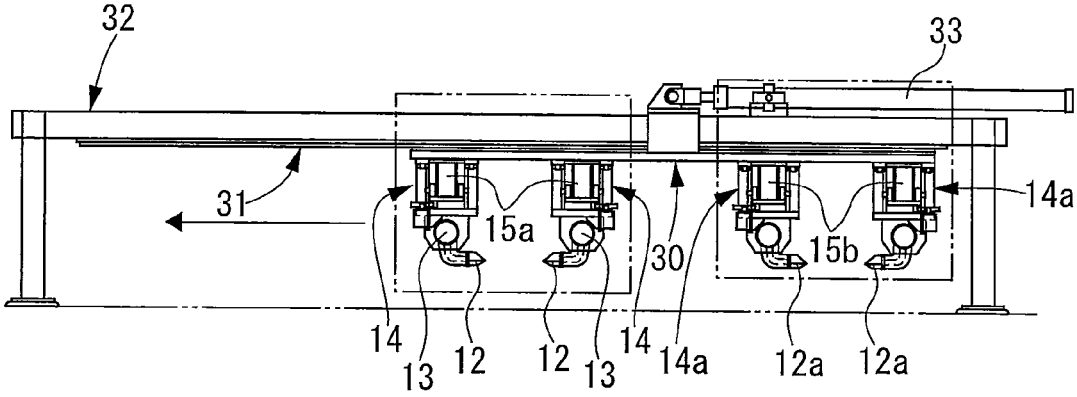
FIG. 3B is an explanation drawing showing the status of movement of the wiping apparatus on the nozzle replacing device.
Figure 3C:
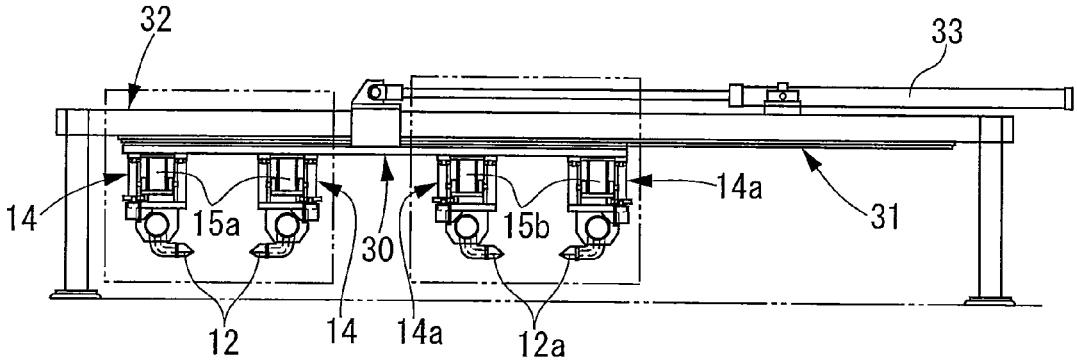
FIG. 3C is an explanation drawing showing the status of movement of the wiping apparatus on the nozzle replacing device.
Figure 3D:
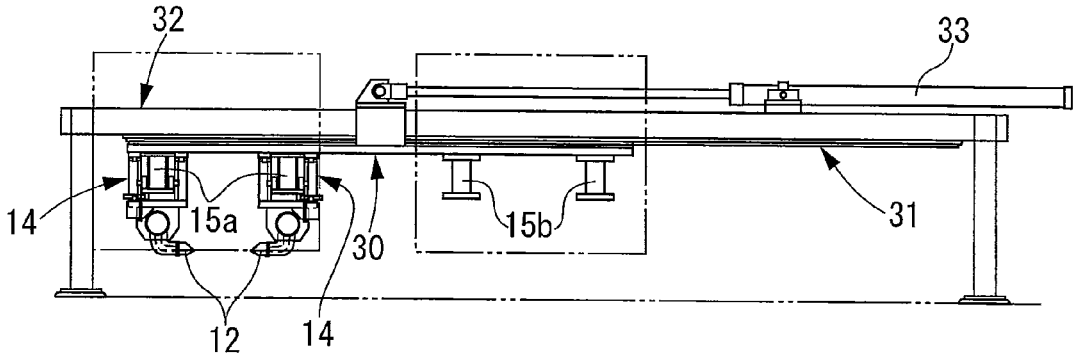
FIG. 3D is an explanation drawing showing the status of movement of the wiping apparatus on the nozzle replacing device.
Figure 4:
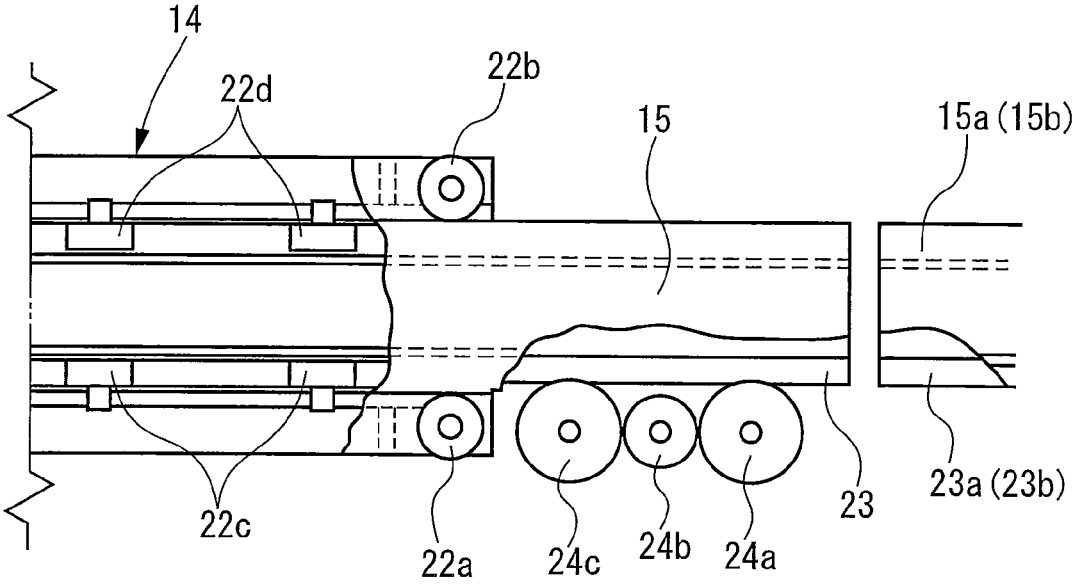
FIG. 4 is a plan view of essential parts of guides and a drive mechanism.
Figure 5:
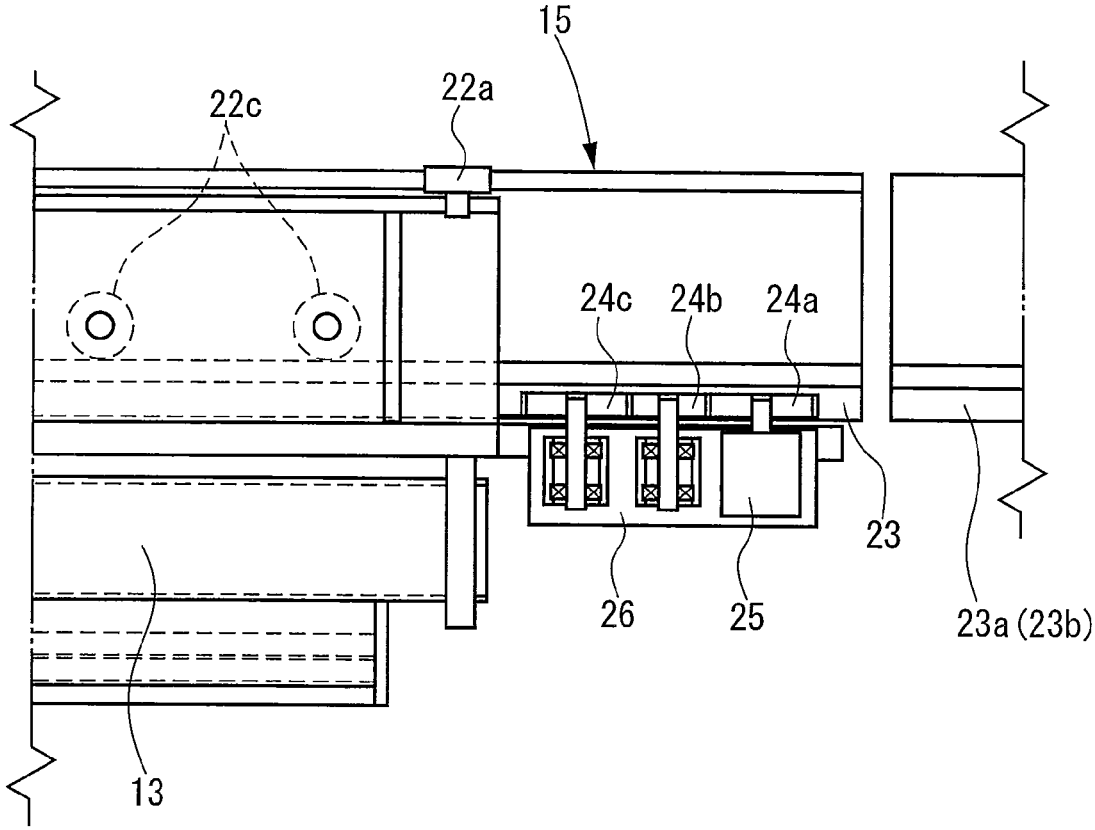
FIG. 5 is a front view of the essential parts of the guides and the drive mechanism.
Figure 6:
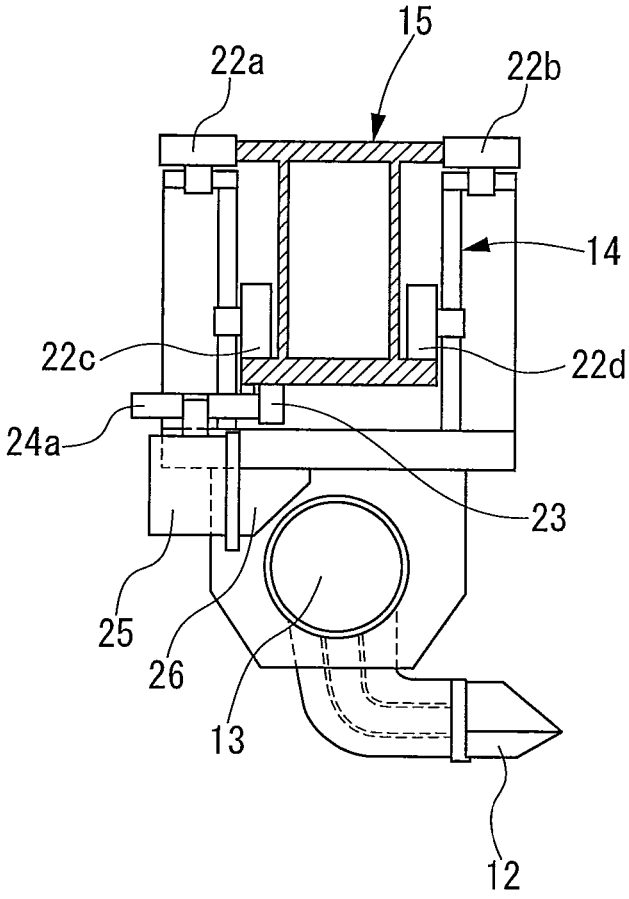
FIG. 6 is a side view of the essential parts of the guides and the drive mechanism.
Figure 7A:
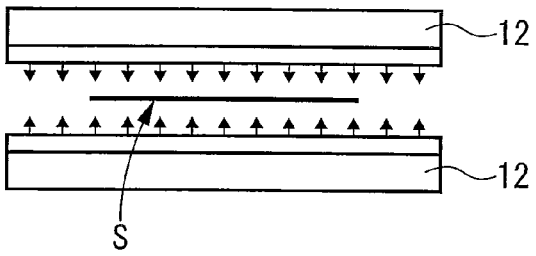
FIG. 7A is a system drawing of a nozzle replacing method without the use of a shift device after nozzle withdrawal, showing Embodiment 2 of the present invention.
Figure 7B:
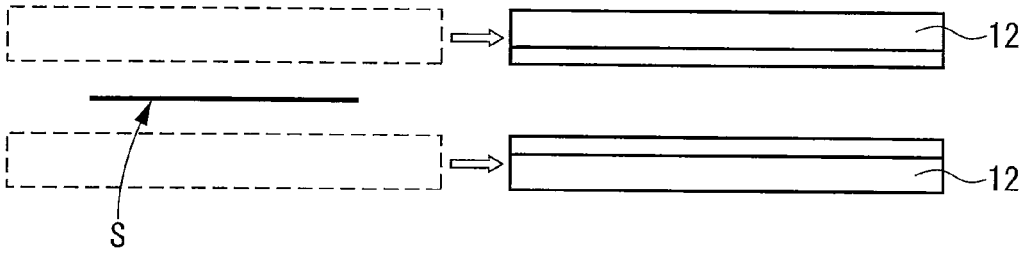
FIG. 7B is a system drawing of the nozzle replacing method without the use of the shift device after nozzle withdrawal.
Figure 7C:
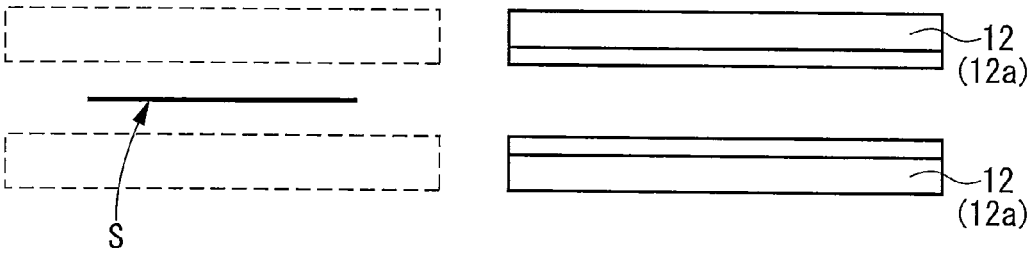
FIG. 7C is a system drawing of the nozzle replacing method without the use of the shift device after nozzle withdrawal.
Figure 7D:
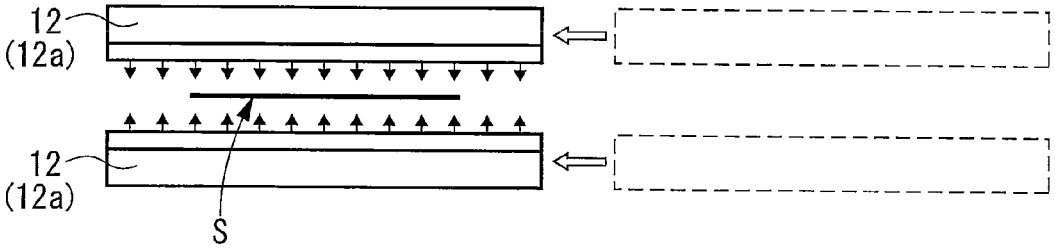
FIG. 7D is a system drawing of the nozzle replacing method without the use of the shift device after nozzle withdrawal.

FIG. 1 is a schematic configurational side sectional view of a wiping apparatus on a continuous hot dip galvanizing line showing Embodiment 1 of the present invention. FIG. 2 is a plan view of gas wiping devices and a nozzle replacing device. FIG. 3A is a sectional view taken along line A-A in FIG. 2. FIGS. 3B to 3D are explanation drawings showing the status of movement of the wiping apparatus on the nozzle replacing device. FIG. 4 is a plan view of essential parts of guides and a drive mechanism. FIG. 5 is a front view of the essential parts of the guides and the drive mechanism. FIG. 6 is a side view of the essential parts of the guides and the drive mechanism.

As shown in FIG. 1, a pair of gas wiping devices 11 are provided to oppose the front side and the back side of a strip (coated steel sheet or plate) S exiting from a molten metal coating pot 10 and traveling upward. A gas is blown on the surfaces of the strip S from wiping nozzles 12 of these gas wiping devices 11, whereby the amount of a coating thickness (molten metal thickness, film thickness) can be adjusted.

In the respective gas wiping devices 11, headers 13 for supplying a high pressure gas from a gas supply source (located outside the drawing, and not shown) to the respective wiping nozzles 12 are supported by front and rear main beams (guides) 15, as a pair, of a rectangular cross section via casing-shaped movable frames 14, which are open on the upper surface thereof, in such a manner as to be movable in the strip width direction of the strip S.

The respective main beams 15 are supported by right and left hoisting frames 16 as a pair via linear guides 17 in such a manner as to be movable independently of each other in the entry and delivery direction (line direction). These main beams 15 are moved by the extension or contraction of front and rear nozzle opening/closing jacks 18 as a pair which are horizontally mounted on the hoisting frames 16. That is, the distance (spacing) between the pair of wiping nozzles 12 is adjustable.

Each hoisting frame 16 is supported in an ascendable and descendable manner by front and rear guide rods 20 as a pair which are erected on bases 19. Nozzle raising/lowering jacks 21, which are likewise mounted upwardly on the bases 19, are extended or contracted, whereby the hoisting frame 16 is raised or lowered. That is, the height of the pair of wiping nozzles 12 from the surface of the bath in the molten metal pot 10 can be adjusted.

The movable frame 14, as shown in FIGS. 4 to 6, has a plurality of wheels 22*a*, 22*b* rolling over the front end surface and the rear end surface of an upper wall portion of each of the main beams 15 and sub-beams (guides) 15*a*, 15*b* (of the same shape as that the main beam 15) of a nozzle replacing device 28 (to be described later), and a plurality of wheels 22*c*, 22*d* rolling over the front upper surface and the rear upper surface of a lower wall portion of each of the main beams 15 and the sub-beams 15*a*, 15*b*.

A motor 25 is mounted on a front lower portion of the movable frame 14 via a bracket 26, and a drive pinion 24*a* fixedly provided on an output shaft of the motor 25 meshes with a rack 23 which extends in the plate width direction of the strip S while being laid on the front lower surface of the lower wall portion of each of the main beams 15 and the sub-beams 15*a*, 15*b*.

The rack 23 is also in mesh with a driven pinion 24*c* meshing with the drive pinion 24*a* via an idle pinion 24*b*. The idle pinion 24*b* and the driven pinion 24*c* are also rotatably supported by the bracket 26.

Thus, the movable frame 14, to which the wiping nozzle 12 and the header 13 are integrally assembled, is self-propelled along the main beam 15 upon rotation of the drive pinion 24*a* by the motor 25, with its right-and-left direction being regulated by the plurality of wheels 22*a*, 22*b* and its height being regulated by the plurality of wheels 22*c*, 22*d*.

As shown in FIG. 2 and FIGS. 3A to 3D, the nozzle replacing device 28 (to be described later) is installed at a rearrangement position on one side of an on-line position where the molten metal coating pot 10 is present.

In the nozzle replacing device 28, right and left slide bases 30 as a pair are supported on the lower surfaces of right and left gate-shaped (when viewed sideways) frames 32 as a pair, which are installed on the floor, via linear guides 31 in such a manner as to be slidable in the traveling direction of the strip S. Upon extension or contraction of right and left shift cylinders 33 as a pair which are mounted horizontally on the upper surfaces of the frames 32, the slide bases 30 are adapted to slide.

Two sets of the sub-beams 15*a*, 15*b* for replacing the front and rear nozzles as a pair are provided in the fore-and-aft direction to span the right and left slide bases 30 as a pair. Any one set of the sub-beams, 15*a* or 15*b*, are located on a longitudinal extension of the main beams 15 adjusted to have predetermined spacing therebetween by the nozzle opening/closing jacks 18. The other set of the sub-beams, 15*b* or 15*a*, are located at a wait position offset in the traveling direction of the strip S.

The wait positions are set on both sides of the one set of the sub-beams, 15*a* or 15*b*, located on the longitudinal extension of the main beams 15. Wiping nozzles 12*a* (and header 13*a*) for replacement are supported by the other set of sub-beams 15*b* or 15*a*, located at the wait position, via movable frames 14*a* so as to be movable in the strip width direction of the strip S, as are the wiping nozzles 12 by the main beams 15.

Because of the above features, when the gas wiping devices 11 (wiping nozzles 12) are in operation in the state shown in FIG. 1 and FIG. 2, there may be a case, for example, where the wiping nozzle 12 is scarred by a collision with the strip S, or the molten metal by a splash adheres to the wiping nozzle 12. In this case, a quality defect (coating irregularities, streaks, etc.) on the surface of the strip after coating may occur. This requires maintenance work including the replacement of the wiping nozzle 12.

Under this situation, the following adjustment is made, for example, in the present embodiment: The front and rear main beams 15 as a pair located on the on-line position are positionally adjusted by the nozzle opening/closing jacks 18 to lie on the longitudinal extension of the front and rear sub-beams 15*a* as a pair located on the rearrangement position.

In this state, the motor 25 for the movable frames 14 supported on the front and rear main beams 15 as a pair is driven to rotate the drive pinion 24*a* and the driven pinion 24*c*. As a result, the movable frames 14 are self-propelled on the front and rear main beams 15 as a pair which have the racks 23 in mesh with the drive pinion 24*a* and the driven pinion 24*c*. In the meantime, the drive pinion 24*a* and the driven pinion 24*c* mesh with racks 23*a* of the front and rear sub-beams 15*a* as a pair located at the rearrangement position, whereupon the movable frames 14 are moved onto the sub-beams 15*a* (see FIG. 3A→FIG. 3B).

At this rearrangement position, the wiping nozzles 12 supported by the movable frames 14 are subjected to maintenance and inspection. If any deposit on the nozzle, whose removal failed on line, has been successfully removed, for example, the wiping nozzles 12 need not be replaced, and the movable frames 14 may be self-propelled again in the opposite direction, and returned onto the main beams 15 located at the on-line position.

If the wiping nozzles 12 are to be replaced, on the other hand, the right and left shift cylinders 33 as a pair are extended to shift the right and left slide bases 30 as a pair leftward in the drawing, thereby bringing the front and rear sub-beams 15*b* as a pair residing at the right-hand wait position in the drawing onto the longitudinal extension of the main beams 15, and also bringing the sub-beams 15*a* located on the longitudinal extension of the main beams 15 to the wait position on the opposite side (left-hand side in the drawing) (see FIG. 3B→FIG. 3C).

Then, the movable frames 14*a* on the front and rear sub-beams 15*b* as a pair located at the rearrangement position are self-propelled and moved onto the front and rear main beams 15 as a pair located at the on-line position. As a result, the wiping nozzles 12*a* (and the headers 13*a*) for replacement, which are integrally assembled to the movable frames 14*a*, become usable instead of the wiping nozzles 12 (and the headers 13) which have been used (see FIG. 3C→FIG. 3D).

The front and rear wiping nozzles 12 (and the headers 13) as a pair which have been used up to then are replaced at the wait position in such a manner that the entire movable frames 14 including the wiping nozzles 12, etc. are replaced, or the wiping nozzles 12 alone are replaced. Alternatively, the wiping nozzles 12 which have been used until then may be subjected to maintenance and inspection, without being replaced, at the wait position.

According to the present embodiment, as described above, the wiping nozzles 12 are linearly moved via the movable frames 14 from the on-line position to the rearrangement position in the strip width direction of the strip S. By so doing, maintenance and inspection of the wiping nozzles 12 can be performed, without nozzle replacement, at the destination of the movement. After movement of the wiping nozzles 12, the two sets of the sub-beams 15*a* and 15*b* at the rearrangement position are shifted in the traveling direction of the strip S, and the wiping nozzles 12*a* for replacement are linearly moved via the movable frames 14*a* from the rearrangement position to the on-line position in the strip width direction of the strip S. In this manner, nozzle replacement can be performed.

On this occasion, maintenance of the wiping nozzles 12, 12*a*, including their replacement, can be performed using treatment, such as speed reduction, without cutting the strip S or stopping the line. Thus, a decrease in downtime leads to an increase in the manufacturing efficiency. During movement of the wiping nozzles 12, 12*a*, moreover, they do not interfere with the surrounding facilities. Thus, there are no limitations on the designing of the nozzle replacing device.

Embodiment 2

FIGS. 7A to 7D are system drawings of a nozzle replacing method without the use of a shift device after nozzle withdrawal, showing Embodiment 2 of the present invention.

This is an embodiment configured such that in Embodiment 1, merely the wiping nozzles 12 (12*a*) are moved in the strip width direction of the strip S with the use of the movable frames 14, etc. between the main beams 15 located at the on-line position and the sub-beams 15*a* located at the rearrangement position, whereby nozzle replacement or maintenance and inspection can be performed at the rearrangement position.

That is, the wiping nozzles 12 located at the on-line position are moved to the rearrangement position (see FIG. 7A→FIG. 7B) and, at this rearrangement position, maintenance and inspection of the wiping nozzles 12 are carried out, or the wiping nozzles 12 are replaced by the wiping nozzles 12*a* for replacement, which are stored in other place, by means of a crane or the like. Then, the inspected wiping nozzles 12 or the alternative wiping nozzles 12*a* are moved again to the on-line position (see FIG. 7C→FIG. 7D). Thereafter, this procedure is repeated.

According to this embodiment, the same actions and effects as those in Embodiment 1 are obtained and, in addition, the advantage is presented that an ordinary operator can promptly perform maintenance and inspection, including replacement, of the wiping nozzles without requiring a special technique such as a crane operation.

Embodiment 3

FIGS. 8A to 8D are system drawings of a nozzle replacing method, showing Embodiment 3 of the present invention.

Figure 8A:
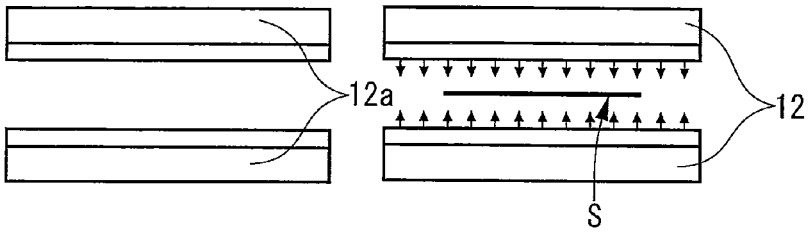
FIG. 8A is a system drawing of a nozzle replacing method, showing Embodiment 3 of the present invention.
Figure 8B:
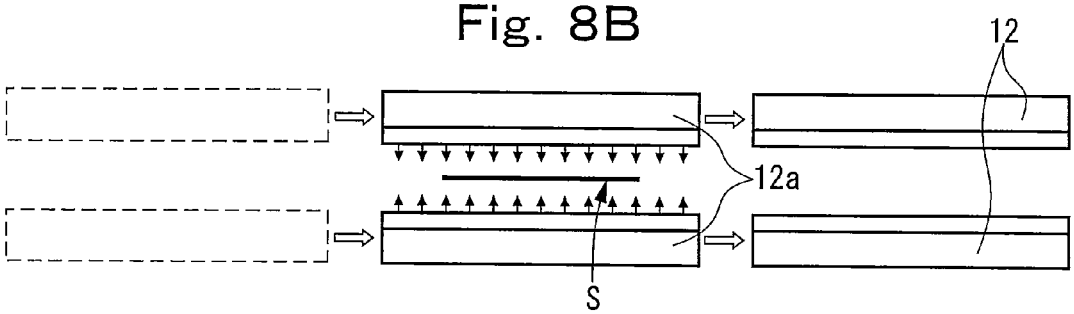
FIG. 8B is a system drawing of the nozzle replacing method.
Figure 8C:
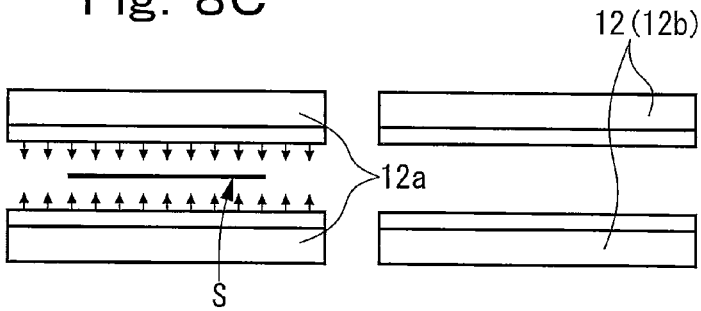
FIG. 8C is a system drawing of the nozzle replacing method.
Figure 8D:
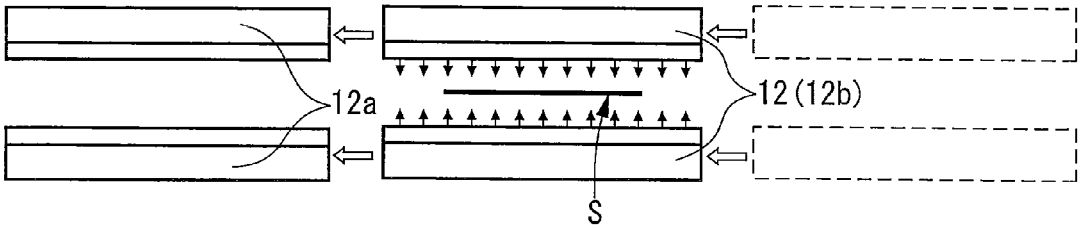
FIG. 8D is a system drawing of the nozzle replacing method.
Figure 9:
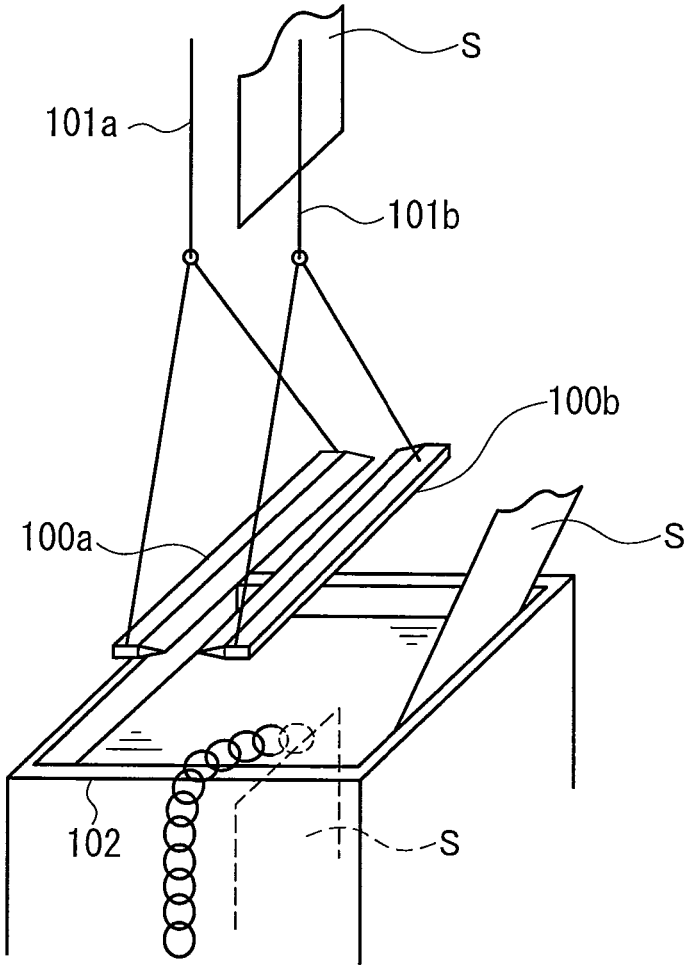
Fig. 9 Prior Art
FIG. 9 is an explanation drawing of a conventional nozzle replacing method.
Figure 10A:
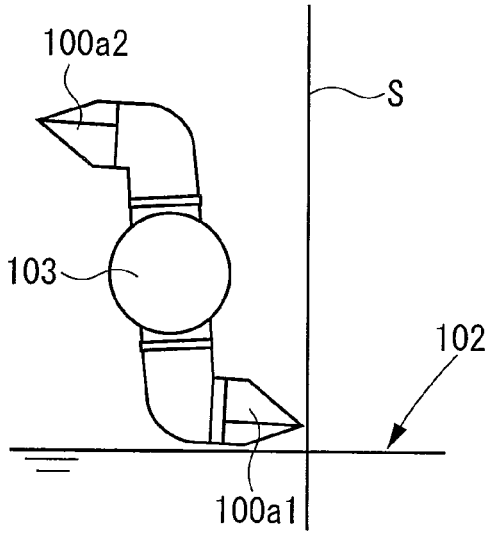
Fig. 10A Prior Art
FIG. 10A is an explanation drawing of a nozzle replacing method for a turret nozzle.
Figure 10B:
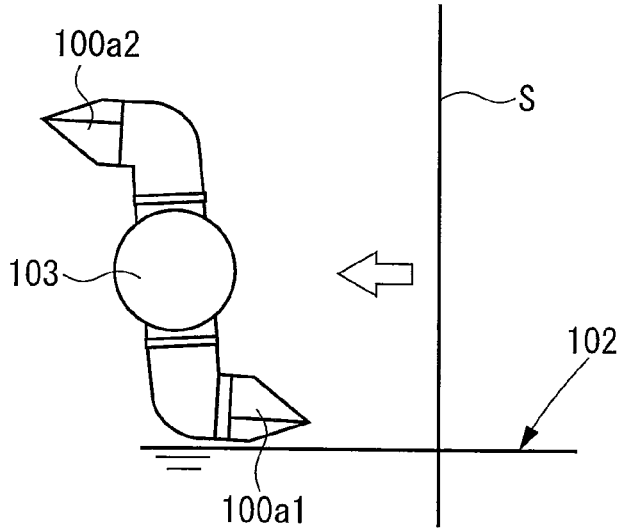
Fig. 10B Prior Art
FIG. 10B is an explanation drawing of the nozzle replacing method for the turret nozzle.
Figure 10C:
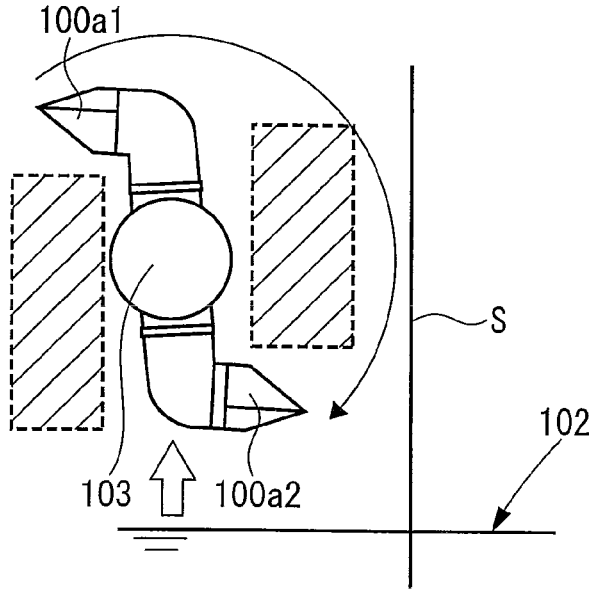
Fig. 10C Prior Art
FIG. 10C is an explanation drawing of the nozzle replacing method for the turret nozzle.

This is an embodiment configured such that in Embodiment 1, the rearrangement positions are set on both sides of the on-line position; and when the wiping nozzles 12 located at the on-line position are moved in the strip width direction of the strip S to one of the rearrangement positions, the wiping nozzles 12*a* for replacement which have been set beforehand at the other rearrangement position are also moved simultaneously in the strip width direction of the strip S to be set at the on-line position (see FIG. 8A→FIG. 8B).

With the wiping nozzles 12*a* being in operation at the on-line position, the wiping nozzles 12 located at the one rearrangement position are either subjected to maintenance and inspection, or replaced by wiping nozzles 12*b* for replacement. Then, when the wiping nozzles 12*a* located at the on-line position are moved to the other rearrangement position, the wiping nozzles 12 or 12*b* located at the one rearrangement position are also moved simultaneously in the strip width direction of the strip S to be set at the on-line position (see FIG. 8C→FIG. 8D).

According to this embodiment, the same actions and effects as those in Embodiment 1 are obtained and, in addition, the advantage is offered that maintenance and inspection, including replacement, of the wiping nozzles can be carried out more promptly than in Embodiment 1.

It goes without saying that the present invention is not limited to the above-described embodiments, and various changes and modifications, such as changes or modifications in the guide and the drive mechanism including the motor, may be made without departing from the gist of the present invention.

The gas wiping apparatus according to the present invention can be applied to continuous molten metal plating equipment

REFERENCE SIGNS LIST

10 Molten metal coating pot
11 Gas wiping device
12, 12*a* Wiping nozzle
13, 13*a* Header
14, 14*a* Movable frame
15 Main beam (guide)
15*a*, 15*b* Sub-beam (guide)
16 Hoisting frame
17 Linear guide
18 Nozzle opening/closing jack
19 Base
20 Guide rod
21 Nozzle raising/lowering jack
22*a* to 22*d* Wheel
23 Rack
24*a* Drive pinion
24*b* Idle pinion
24*c* Driven pinion
25 Motor
26 Bracket
28 Nozzle replacing device
30 Slide base
31 Linear guide
32 Frame
33 Shift cylinder
S Strip (plated steel sheet or plate)

The invention claimed is:

1. A gas wiping apparatus for blowing a gas on a front side and a back side of a steel strip, which exits from a hot-dip plating bath and travels upward, comprising:

wiping nozzles that blow the gas to adjust an amount of a plating deposit on the front side and the back side of the steel strip, main guides that support the wiping nozzles when the wiping nozzles are in a first position where the wiping nozzles oppose the steel strip;

sub-guides that support the wiping nozzles when the wiping nozzles are in a second position for maintaining and replacing the wiping nozzles, the sub-guides linearly extend from one end of the main guides beyond a width of the steel strip;

a drive unit that moves the wiping nozzles between the first and second positions; and movable frames that support the wiping nozzles, wherein the wiping nozzles move between the first and second positions by moving the movable frames along the main guides and the sub-guides by the drive unit, and the sub-guides include first sub-guides and second sub-guides that extend parallel to one another, the first sub-guides being configured to support the wiping nozzles, and the second sub-guides being configured to support replacement wiping nozzles, wherein the gas wiping apparatus further includes, frames that extend in a direction perpendicular to the sub-guides and support the first and second sub-guides movably in the perpendicular direction, such that sub-guides move between a position where the first sub-guides linearly extend from the one end of the main guides and a position where the second sub-guides linearly extend from the one end of the main guides.

* * * * *